United States Patent [19]

Steadman

[11] 4,392,192

[45] Jul. 5, 1983

[54] LAMP STANDARD ASSEMBLY

[76] Inventor: Rufus P. Steadman, Rte. 1, Box 333, Middleton, Tenn. 38052

[21] Appl. No.: 373,129

[22] Filed: Apr. 29, 1982

[51] Int. Cl.[3] ..... F21V 19/02

[52] U.S. Cl. ..... 362/418; 362/427; 362/431

[58] Field of Search ..... 362/418, 431, 427

[56] References Cited

U.S. PATENT DOCUMENTS 4,242,726 12/1980 Steadman ..... 362/418

*Primary Examiner*—Stephen J. Lechert, Jr.

*Attorney, Agent, or Firm*—Cohn, Powell & Hind

[57] ABSTRACT

This lamp standard assembly includes a lamp standard having an upper lamp housing and ground connected post, and a lamp assembly mounted within the lamp standard. The lamp standard includes a lower access opening for receiving the lamp assembly and an interior electrical supply. The lamp assembly includes a lamp-carrying head and a conductor-carrying semi-flexible stem, and the head and the stem are pivotally connected to provide an articulated relationship between the head and the stem so that the stem can be used to push the head up the interior of the post and position the lamp within the lamp housing.

11 Claims, 9 Drawing Figures

LAMP STANDARD ASSEMBLY

BACKGROUND OF THE INVENTION

This invention relates generally to lamp standard assemblies and particularly to a lamp assembly which is installed within the lamp standard from the lower portion of the lamp standard by means of an elongate stem which forms part of the lamp assembly.

Relatively tall lamp standard assemblies and particularly those used for outdoor street lighting are often troublesome to service because of the difficulty of access to the elevated lamp.

Attempts have been made to solve this problem and the most pertinent known art in this area is commonly owned U.S. Pat. No. 4,242,726. This particular light system provides a lamp assembly which can be used for overhanging street lamps and consists essentially of a lamp-carrying head having a flexible stem attached thereto. The lamp post is provided with a relatively large access opening to permit the assembly to be received within the post interior and the stem is carried by the cover for the opening. In this particular assembly the conductor is attached to the outside of the flexible stem and has a free end which attaches to an electrical supply outlet outside of the lamp post and utilizes a separate ballast assembly.

The present lamp standard assembly is an improvement upon the system disclosed in U.S. Pat. No. 4,242,726 in that it does not require a large access opening and is not supported by the access opening cover.

SUMMARY OF THE INVENTION

This lamp standard assembly utilizes a relatively small access opening in the lamp standard for receiving an articulated assembly, and the lamp assembly includes a stem which is supported by the lamp standard.

The lamp standard assembly includes a post having an upper lamp-receiving opening, a lower access opening, and an electrical supply means; a lamp assembly including a head and a stem, the head including a lamp-carrying means and the stem including conductor means connected between the lamp-carrying means and the electrical supply means; and a pivot means operatively connecting the lamp-carrying means and the stem to permit relative axial movement between said portions so that the head can be received through the access opening and pushed longitudinally up the lamp standard by the stem and through the lamp-receiving opening.

In one aspect of this invention the stem includes a substantially semi-flexible conduit and the conductor is disposed within the conduit.

In another aspect of the invention the lamp assembly head includes an upper frame providing the lamp-carrying means and a lower frame providing a ballast-carrying means, and the pivot means includes a first hinge means connecting upper and lower frames.

In yet another aspect of the invention the pivot means includes second hinge means connecting the stem and the ballast-carrying frame.

In still another aspect of the invention the stem includes an electrical plug at the lower end of the conduit, and the electrical supply means includes a support disposed within the post and having an electrical outlet receiving the conductor plug, said bracket supporting the lamp assembly.

In yet another aspect of the invention the height of the access opening is smaller than the combined length of the upper and lower frames, and the first hinge means between the upper and lower frames permits the head to be articulated to facilitate entry of the head within the access opening.

In yet another aspect of the invention the axes of the first and second hinge means are disposed in spaced parallel relation transversely of the axis of the stem to provide the head with two degrees of articulation in the direction of the axis of the stem.

In another aspect of the invention the post is substantially cylindrical and the maximum distance across the upper and lower frames is substantially equal to but less than the internal diameter of the post.

In still another aspect of the invention the stem includes a twist-releasable electrical connector at its upper end to permit the lamp assembly to be disconnected from the stem and facilitate replacement of the head.

DESCRIPTION OF THE PREFERRED EMBODIMENT

Figure 1:
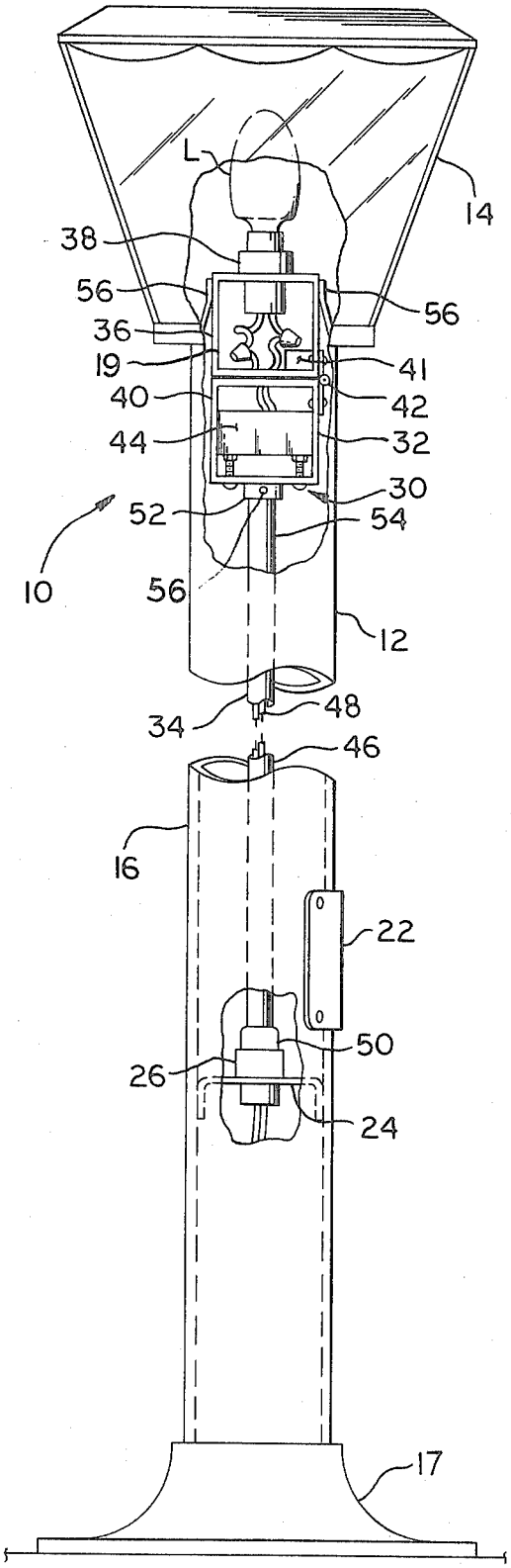
FIG. 1 is an elevational view of the lamp standard assembly.
Figure 2:
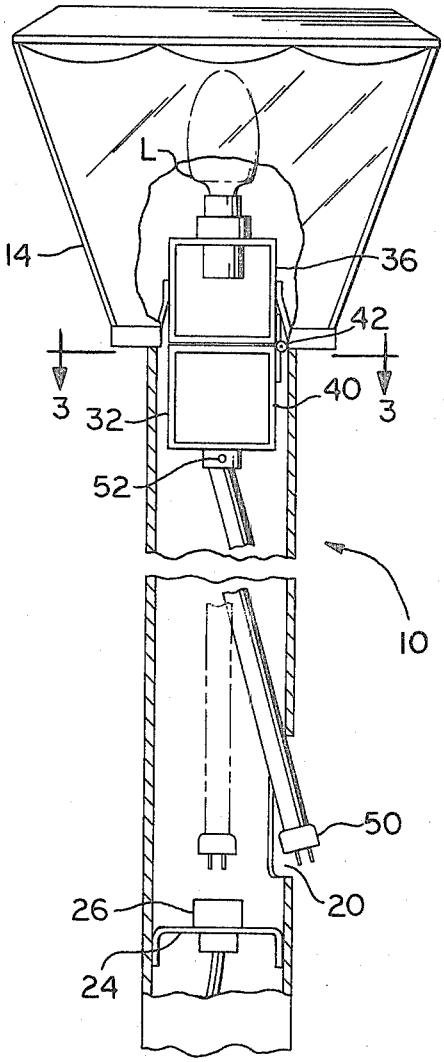
FIG. 2 is a fragmentary longitudinal sectional view of said assembly with the ballast omitted.
Figure 3:
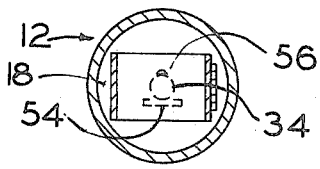
FIG. 3 is a sectional plan view taken on line 3—3 of FIG. 2.

Referring now by reference numerals to the drawings and first to FIGS. 1, 2 and 3, it will be understood that the lamp standard assembly generally indicated by numeral 10 includes a lamp standard 12 having a removable lamp assembly 14 disposed therewithin.

The lamp standard 12 includes an upper lamp housing 16 and an elongate ground-supported post 18 having a base 17. In the embodiment shown, the post 18 is substantially straight and includes a hollow interior communicating with the lamp housing 16 through an upper end opening 19. Access to the interior of the post 18, which in the preferred embodiment is substantially cylindrical in configuration, is provided by means of a lower access opening 20 having a removable cover 22 bolted or otherwise attached to the post. The post 18 is provided with an interior support bracket 24 attached to the wall of the post, as by fasteners, the bracket 24 having an electrical outlet 26 attached thereto and constituting an electrical supply means.

The lamp assembly 14 is removably mounted within the post 18 and includes a head 32 and a stem 34. The head 32 includes an upper frame 36 having a lamp connection 38, said upper frame constituting a lamp-carrying means. A lower frame 40 is connected to the upper frame by means of a hinge connection 42, the lower frame 40 constituting a ballast-carrying means which provides a mounting for the ballast. A starter 41 is mounted in the upper frame and a capacitor (not shown) if required, is mounted in either the upper frame 36 or the lower frame 40.

The lamp assembly stem 34 includes an outer conduit 46 and an inner conductor 48. In the embodiment shown, the conduit has a degree of flexibility to permit it to bend but is sufficiently rigid to support its own weight and the weight of the head 32. These semi-flexible qualities are to be found in "C" type PVC (polyvinylchloride) of the type used for hot water supplies.

The conductor 48 is connected at one end to the lamp connection 38 and at the other end to a male plug 50, which is fixedly attached to the remote end of the conduit 34. The plug 50 is electrically connectible to the female electrical outlet 26 provided on the interior support bracket 24.

At its upper end, the stem is connected to the lamp assembly lower frame 40 by means of a hinge connection 52 provided by a lug 54 welded, or otherwise attached, to the lower frame 40, and a pin connection 56 as shown in FIGS. 1 and 2. The lamp assembly head 32 is held in place by opposed elements 56 attached to the lamp housing. The axes of the hinge connection 42 and the hinge connection 52 are disposed in spaced parallel relation and said hinge connections, which constitute first and second hinge means, provide an articulated pivot means connecting the lamp-carrying upper frame 36 to the stem 32, said pivot means providing two degrees of articulation to said upper frame 36 relative to said stem 32.

Figure 9:
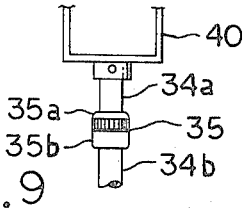
FIG. 9 is a fragmentary view of a lamp assembly having a modified stem.

A modified stem is shown in FIG. 9 in which the stem is formed from two connectible parts **34*a* and 34*b* and includes a twist-releasable electrical connector 35. In the embodiment shown, the connector 35 is of a conventional type, commonly known as a twist-lock-plug, and the two parts of the connector indicated by 35*a* and 35*b* are fixedly attached to associated conduit parts 34*a* and 34*b* such that the lamp assembly head 32, together with the short upper conduit part 34*a***, can be replaced as a unit.

Although a lamp housing 16 of some size is shown in the embodiment, the lamp housing can be reduced or, if desired, a seal beam type of lamp can be used in lieu of a separate lamp and housing.

It is thought that the structural features of this lamp standard assembly have become fully apparent from the foregoing description of parts, but for completeness of disclosure the installation of the lamp assembly will be described with particular reference to FIGS. 4 through 8 which have been simplified for the better understanding of the installation procedure.

Figure 8:
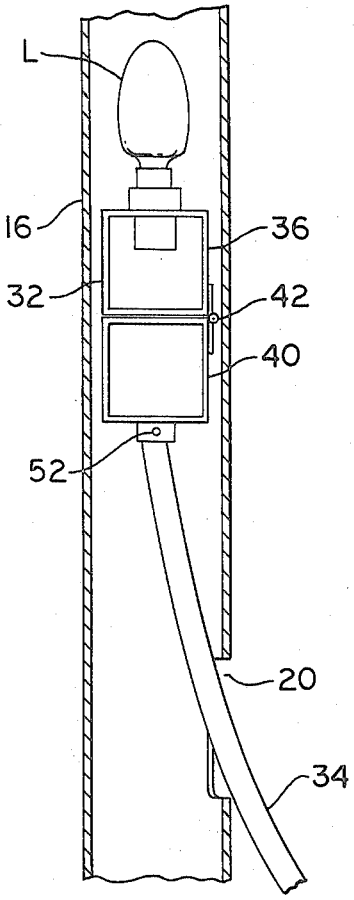
FIGS. 4 through 8 are simplified sectional elevational views illustrating the installation of the lamp assembly within the lamp standard.
Figure 7:
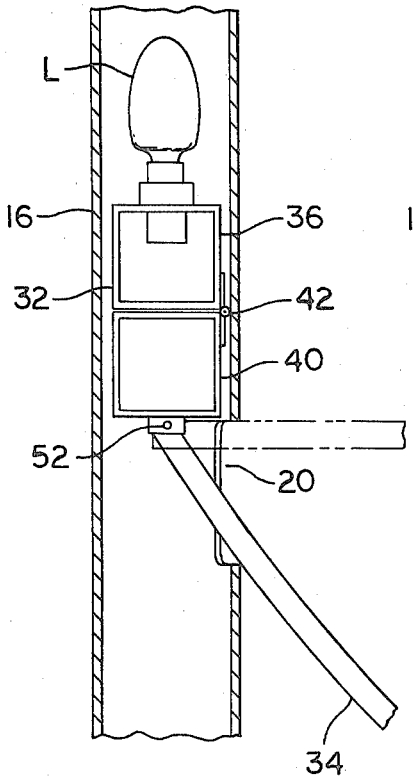
Figure 6:
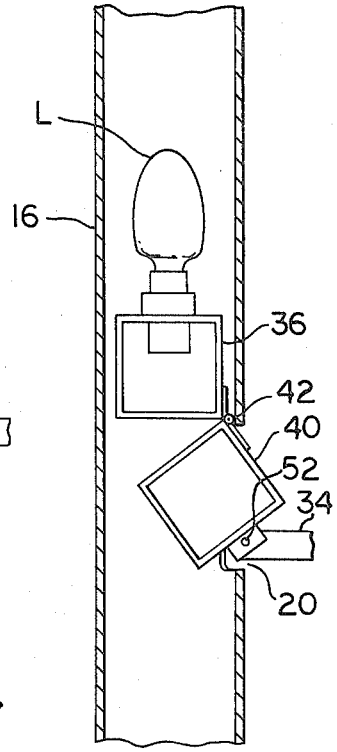
Figure 5:
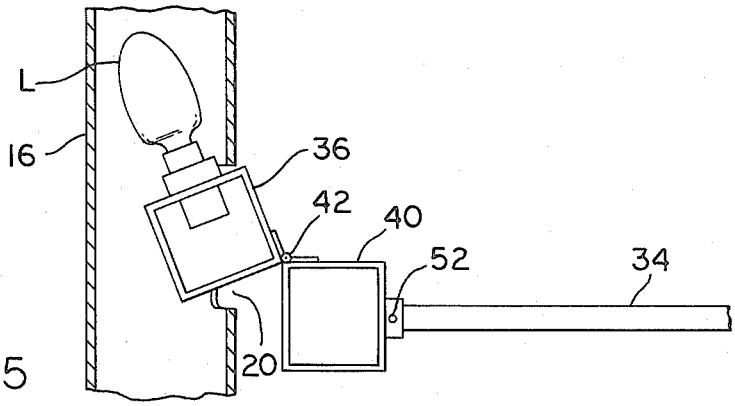
Figure 4:
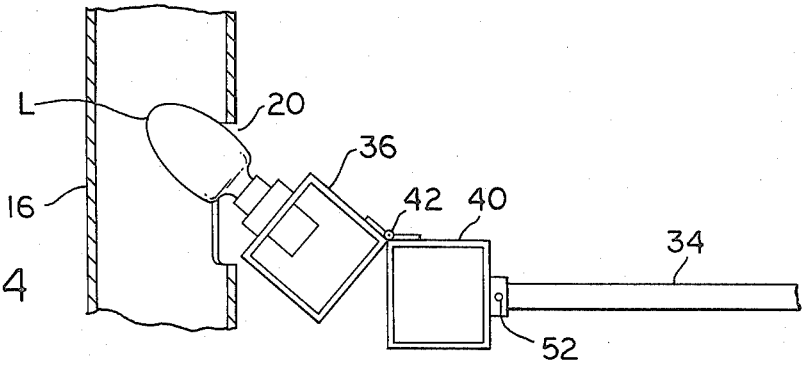

As shown in FIG. 4, the lower access opening 20 is quite small and is not large enough to permit sideway entry of the combined upper and lower frames 36 and 40. For example, with a four and one-half inch outside diameter ($4\frac{1}{2}''$ O.D.) extruded metal pole, an opening of approximately three inches (3") wide by five and one-half inches ($5\frac{1}{2}''$) long has been used. This results in a retention of about seventy percent (70%) of the available cross-sectional area and minimizes the removal of longitudinal material so that, as a result of keeping the opening small, maximum pole strength is retained. However, in spite of the small access opening, because of the provision of the hinge connection 42, the upper frame 36 carrying the lamp L can be fed into the interior of the post in an angled position relative to the lower frame 40. FIGS. 5 and 6 show sequentially the manner in which the head upper and lower frames 36 and 40 are further fed into the interior of the post 16 with varying degrees of angularity between the two frames. FIG. 7 shows the upper and lower frames 36 and 40 completely disposed within the interior of the post 16 and partly pushed up said post, at which time the stem 34 can be lowered from the horizontal into a downwardly inclined arcuate position by virtue of the hinge connection 52 connecting the stem 34 to the lower frame 40 and by virtue of the flexibility of the stem 34. This inclination permits a vertical component of force to be applied to the head 32 when the installor pushes on the stem 34. From this position, the upper and lower frames 36 and 40 of the head 32 act in concert, as a signel unit, such that the head 32 moves as a piston within the cylinder provided by the interior of the post because of the piston rod-like stem 34. At this time, as shown in FIG. 8, the flexibility of the stem 34 permits the stem to assume a variable arcuate configuration such that the stem 34 can push the head 32 upwardly toward the lamp housing 16. As shown in FIG. 3, the maximum, diagonal distance across the frames 36 and 40 is substantially equal to but less than the internal diameter of the post 18 which facilitates movement of the head 32 up the post as a unit without substantial separation of the frames at the hinge 42.

Referring now to FIG. 2 it will be understood that the head 32 is pushed somewhat higher into the lamp housing 16 than its final position, so that the plug 50 can be swung into vertical alignment with the outlet 26 which is disposed substantially level with the bottom of the access opening 20. Because the length of the stem 34 is substantially equal to the distance between the bottom of the lower access opening 20 and the upper opening 19, the stem 32 and the head 34 can then be lowered as a unit so that the plug 50 and the outlet 26 become electrically engaged. In this position, shown in FIG. 1, the lamp is correctly located within the housing 16 and the weight of the lamp assembly as a whole is substantially carried by the bracket 34. The cover 22 can then be replaced and the lamp standard assembly is ready for use.

It will be understood that the reverse procedure is followed when it is necessary to remove the lamp assembly so that the lamp L can be replaced or other repairs made.

Because of the semi-flexible nature of the conduit 46 and the articulated nature of the connection the height of the lamp standard 12 can be quite great and as much as 30 to 35 feet. This is much greater than would be the case if a rigid conduit were used for the stem 34 since in that case, the height limitation would be governed by the distance of the access opening from the ground. In addition, the flexibility of the stem 34 permits the lamp assembly to be used with an overhanging lamp standard having an arcuate upper portion. Further, the use of a modified, two-part, twist-releasable stem permits the lamp assembly head 32 to be removed from the stem which facilitates immediate replacement of a new head and removal of the old head to the shop for service.

I claim as my invention:

1. A lamp standard assembly comprising:

(a) a lamp standard including an elongate lower ground-supported post having an upper lamp-receiving opening, a lower access opening and an electrical supply means, (b) a lamp assembly including a head and a stem, the head including a lamp-carrying means and the stem including conductor means, the conductor means being operatively connected between the lamp carrying means and the electrical supply means, and (c) pivot means operatively connecting the lamp-carrying means and the stem to permit relative axial movement between the lamp-carrying means and said stem so that the head can be received through the access opening and pushed longitudinally up the post by the stem and through the lamp receiving opening.

2. As assembly as defined in claim 1, in which:
(d) the stem includes a semi-flexible conduit and the conductor is disposed within the conduit.

3. An assembly as defined in claim 1, in which:
(d) the head includes an upper frame providing the lamp-carrying means and a lower frame providing a ballast-carrying means, and
(e) the pivot means includes a first hinge connection between the upper and lower frames.

4. An assembly as defined in claim 1, in which:
(d) the stem includes a substantially semi-flexible conduit, and the conductor is disposed within the conduit,
(e) the head includes an upper frame providing the lamp-carrying means and a lower frame providing a ballast-carrying means, and
(f) the pivot means includes a first hinge connection between the upper frame and the lower frame and a second hinge connection between the stem and the ballast carrying frame.

5. An assembly as defined in claim 1, in which:
(d) the stem includes a substantially semi-flexible conduit and the conductor is disposed within the conduit, said conductor including a plug at the lower end of the conduit, and
(e) the electrical supply means includes a support disposed within the post and having an electrical outlet receiving the conductor plug.

6. An assembly as defined in claim 4, in which:
(g) the height of the access opening is smaller than the combined length of the upper and lower frames and the hinged connection between said upper and lower frames permits the head to be articulated to facilitate entry of the head within said access opening.

7. An assembly as defined in claim 4, in which:
(g) the axes of the first and second hinge means are disposed in spaced parallel relation transversely of the axis of the stem to provide the head with two degrees of articulation in the direction of the axis of the stem.

8. As assembly as defined in claim 4, in which:
(g) the post is substantially cylindrical and the maximum distance across the upper and lower frames is substantially equal to but less than the internal diameter of said post.

9. As assembly as defined in claim 1, in which:
(d) the post is substantially vertical and the stem includes a substantially straight, semi-flexible conduit and the conductor is disposed within the conduit, said conductor including a plug at the lower end of the conduit, and
(e) the electrical supply means includes a support bracket disposed within the post and having an electrical outlet receiving the conductor plug, the stem and the weight of the stem and the head being taken at least in part by the support bracket.

10. An assembly as defined in claim 1, in which:
(d) the stem includes a semi-flexible conduit of "C" type polyvinylchloride and the conductor is disposed within the conduit.

11. As assembly as defined in claim 10, in which:
(e) the stem includes twist-releasable electrical connector at its upper end to permit the lamp assembly to be disconnected from the head to facilitate replacement of the head.

* * * * *